US008517379B2

(12) United States Patent
Bianco et al.

(10) Patent No.: US 8,517,379 B2
(45) Date of Patent: Aug. 27, 2013

(54) LETTERBOX MEDIA DIVERTER

(75) Inventors: Nicola M Bianco, Great Barford (GB); Richard G Hubbard, Bedfordshire (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/494,054

(22) Filed: Jun. 12, 2012

(65) Prior Publication Data

US 2012/0248683 A1 Oct. 4, 2012

Related U.S. Application Data

(62) Division of application No. 12/783,795, filed on May 20, 2010, now Pat. No. 8,276,913.

(51) Int. Cl.
*B65H 39/10* (2006.01)

(52) U.S. Cl.
USPC ..... 271/303; 271/291; 271/304

(58) Field of Classification Search
USPC ..... 271/303, 291, 304
See application file for complete search history.

(56) References Cited

U.S. PATENT DOCUMENTS

| | | | | |
|---|---|---|---|---|
| 4,359,217 | A | 11/1982 | Roller et al. | |
| 4,871,163 | A * | 10/1989 | Landa et al. | 271/225 |
| 5,868,387 | A * | 2/1999 | Kida et al. | 271/304 |
| 7,093,831 | B2 * | 8/2006 | Biegelsen et al. | 271/184 |
| 7,984,908 | B2 * | 7/2011 | Chan et al. | 271/291 |
| 8,011,659 | B2 * | 9/2011 | Tabata | 271/303 |
| 2008/0226369 | A1 * | 9/2008 | Park et al. | 399/374 |

* cited by examiner

*Primary Examiner* — Luis A Gonzalez

(57) ABSTRACT

A 3-way letterbox media diverter directs and controls media in 2 forward directions and 1 reverse direction within a printer's paper path. The letterbox design enables actuation of the diverter from a first position to a second position just as the trail edge of a sheet passes a post fuser nip. Once the diverter reaches the second position, an invert nip now controlling the sheet is reversed to thereby invert the sheet. Thus, inversion of the sheet is accomplished in a small space envelope, time to reverse direction is reduced, process speed can be reduced and additional paper guides are eliminated.

1 Claim, 3 Drawing Sheets

LETTERBOX MEDIA DIVERTER

CROSS-REFERENCE TO RELATED APPLICATIONS

This is a divisional of U.S. application Ser. No. 12/783,795 filed May 20, 2010, now U.S. Pat. No. 8,276,913, by the same inventors, and claims priority therefrom. This divisional application is being filed in response to a restriction requirement in that prior application.

BACKGROUND

1. Field of the Disclosure

The present disclosure broadly relates to xerographic printers, and more particularly, to an improved diverter assembly for use in xerographic printers and other machines of the like.

2. Description of Related Art

In the field of reprographic machines, it is often necessary to feed along one of two alternative paths a copy sheet leaving the process of a machine, particularly, when the machine can selectively produce simplex (one-sided) and duplex (two-sided) sheets. Simplex sheets may be fed directly to an output tray, whereas the duplex sheets may pass to a sheet feeder which automatically reverses the direction of movement of a simplex sheet and feeds it back into the processor, but inverted, so that the appropriate data can be applied to the second side of the sheet. An example of such is shown in U.S. Pat. No. 4,359,217 that includes three rollers in frictional or geared contact with each other, to provide two spaced-apart nips, one being an input nip to an associated downstream sheet pocket, and the other being an output nip for extracting each sheet from the pocket.

In addition, known printing systems commonly include two or more media transport paths that divert from one another at certain points and join one another at other points. Thus, a given sheet of media can normally be transported thorough a known printing system along any one of a variety of transport paths. Upon reaching one the diversion points, a sheet of media will not itself select the appropriate media transport path along which movement is desired. As such, mechanical diverters are typically provided immediately in front of the divergent transport path to deflect the sheet long the desired pathway. One example of such a known mechanical diverter includes a gate that extends across the media transport path immediately in front of the diversion point of the transport path. The gate includes an upstream edge and a downstream edge, and is oriented along the transport path such that the downstream edge is pivotally supported at approximately the diversion point of the transport pathway. Thus, the gate creates a diagonally extending blockage across the pathway that is displaceable between first sand second positions corresponding to a sheet media diversion along the first and second transport paths.

These types of diverter gates have drawbacks in view of the advancing performance of printing systems in view of the timing between the passing of a first sheet of media, the movement of the gate to a different position, and the arrival of the second sheet of media. That is, a given printing system will operate using a predetermined inter-document gap (IDG), which generally refers to the spacing between the trailing edge of a first sheet of media and the leading edge of a second sheet of media. However, as the output performance of printing systems continues to be improved, increasingly smaller IDGs are expected to be used.

It is well known that the arrival of a second sheet of media at the diversion point prior to a gate reaching a desired position could result in the leading edge of the sheet of material contacting the upstream edge of the gate and thereby creating a jam or other undesirable condition. It will be recognized then that as increasingly smaller IDGs are used, the time available for the gate to move from one position to the other is reduced. As such, the operating speed of the gate can be increased to achieve the desired reaction time. However, it is expected that a practical performance threshold will be eventually reached, above which only marginal increasing gate speeds will be achievable using practical gate configurations.

Therefore, a diverter assembly is needed that overcomes the foregoing and other problems and difficulties.

SUMMARY

Accordingly, a multi-position letterbox media diverter is disclosed that directs and controls media in 2 forward directions and 1 reverse direction within a printer's paper path. The diverter is configured to operate as soon as the trail edge of a sheet passes a fuser exit nip. The letterbox gate moves to direct the sheet to the duplex path so that drives of an inverter can be reversed while simultaneously positioning a lower integrated baffle to direct subsequent sheets to an output tray as needed. Thus, reducing the time required for the sheet to be in the inverter path before reversing sheet direction (or reduces the required transport speed).

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
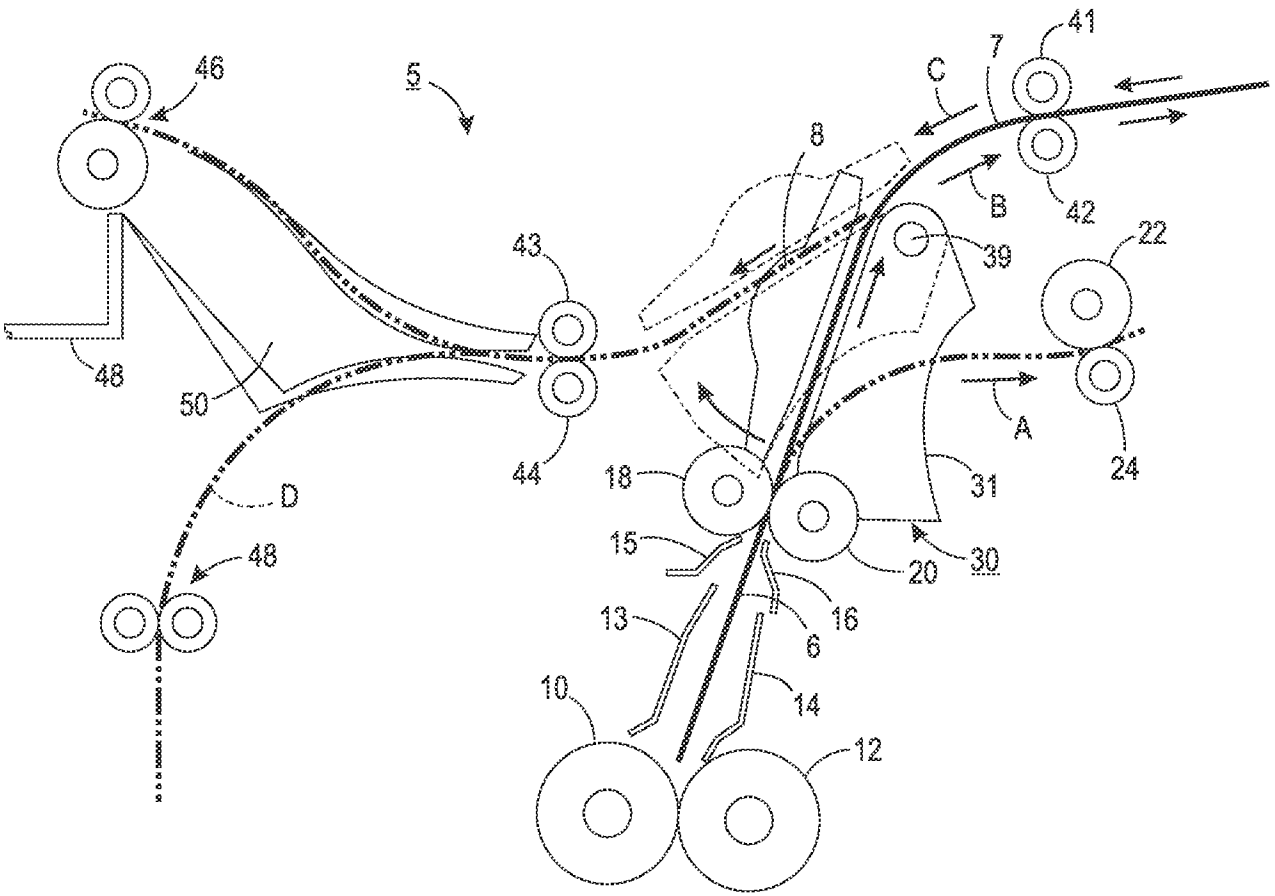
FIG. 1 is a partial frontal view of a printer apparatus that incorporates a letterbox diverter in accordance with the present disclosure.

Turning now to the drawings wherein the showings are for the purpose of illustrating an exemplary embodiment and not intended as a limitation, FIG. 1 illustrates a partial frontal view of a printer apparatus 5 with multiple media paths for accomplishing the printing of simplexed (one-sided) and duplexed (two-sided) media with the use of a dual positioning letterbox media diverter.

Figure 2:
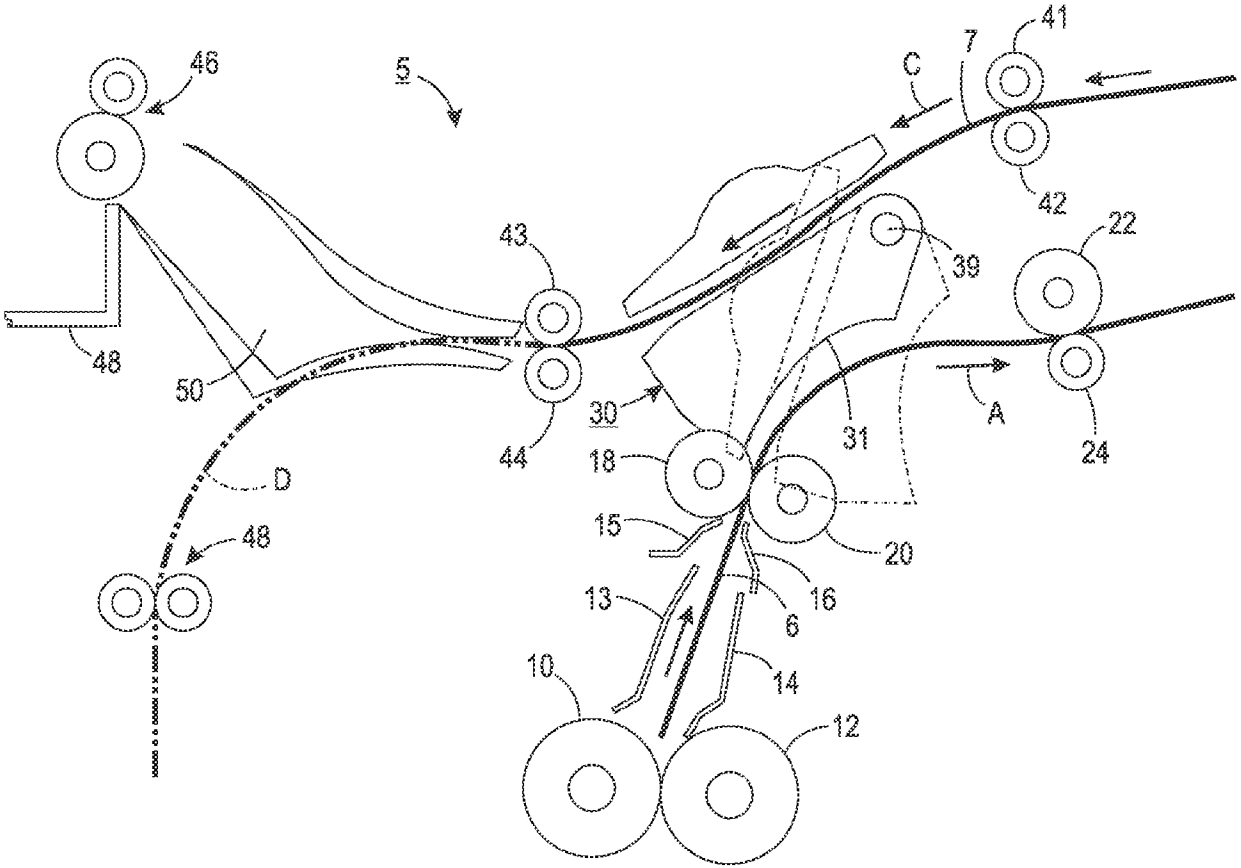
FIG. 2 is a partial frontal view of the printer apparatus of FIG. 1 showing the letterbox diverter in a home position.
Figure 3:
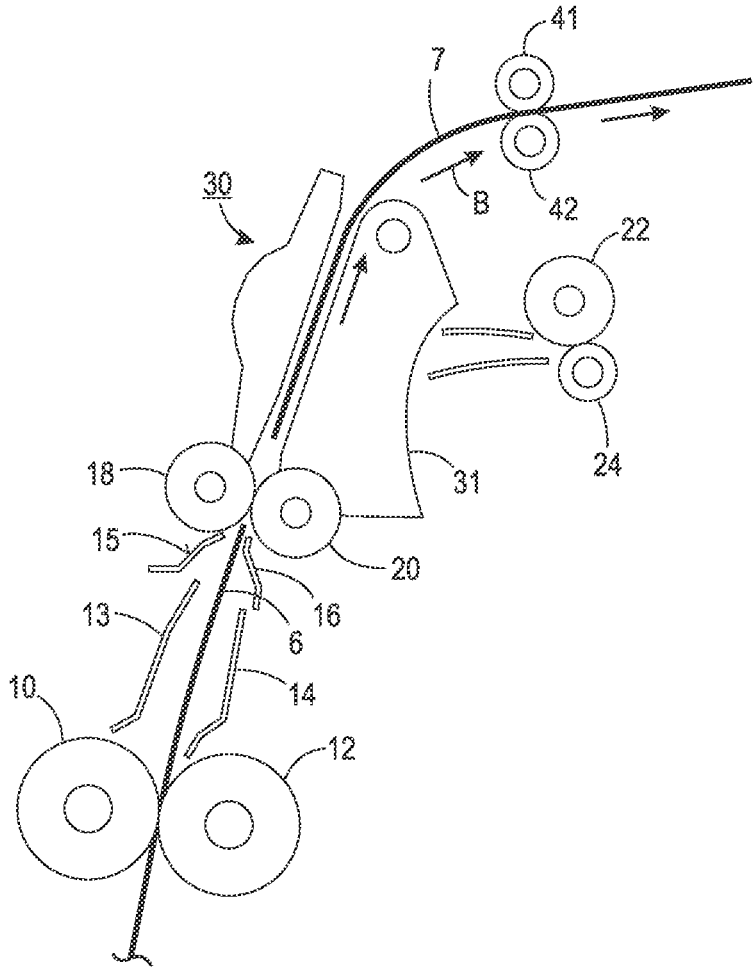
FIG. 3 is a partial frontal view of the printer apparatus of FIG. 1 showing the letterbox diverter activated.

As shown in FIGS. 1-3, a sheet of media 6 has just exited a fuser nip comprised of fuser roll 10 and a backup roll 12 and transported through baffles 13, 14 and baffles 15 and 16 into a post fuser nip formed between drive roll 18 and idler roll 20 and then into letterbox media diverter 30. Letterbox diverter or gate 30 is a multi-positioning diverter that directs a sheet 6 into a simplex path in the direction of arrow A when in a first or home position while simultaneously guiding a sheet 7 into a duplex path in the direction of arrow C. Sheet 6 in FIG. 1 has been met by the letterbox diverter 30 in its home or first position and has been diverted in the direction of arrow A into a first output nip formed between drive roll 22 and idler roll 24 for subsequent forwarding into an output tray. While in this home position, letterbox diverter 30 directs sheet 7 over a top surface thereof 35 into a duplex media path in the direction of arrow C and into a nip formed between reversible rolls 41 and 42. Once the trail edge of sheet 6 passes the post fuser nip the diverter is actuated and moves to direct the sheet into an invert path B so that reversible rolls 41 and 42 can be reversed to invert the sheet while simultaneously positioning an integral lower baffle 31 of gate 30 to direct subsequent sheets to the first output nip. This arrangement accomplishes inversion of sheets in a small space envelope, reduces the time to reverse direction, reduces process speed time, and eliminates the need for additional guide baffles.

With reference to FIG. 2, a sheet 7 captured in the nip formed between reversible rolls 41 and 42, for inversion and subsequent duplexing, is shown in dotted lines as 8 and driven into the duplex path and through a nip formed between drive roll 43 and idler roll 44 into a dual positioning deflector mechanism 50 which, in a first position, deflects the sheet into a second output nip 46 which in turn drives the sheet into a second output tray 48. Deflector mechanism 50, in a second position, deflects the sheet 8 along duplex path D through nip 48 for transport to a transfer station (not shown) where an image is transferred onto the backside of the sheet. The now duplexed image is then fused by fusing roll 10 and transported to an output tray.

Letterbox diverter 30 is shown in FIG. 1 in its home position feeding a sheet 6 into a nip formed between drive roll 22 and idler roll 24 while simultaneously transporting a sheet 7 out of the diverter through duplex path C. The diverter is rotated on shaft 39 between the home position of FIG. 1 to a second position shown in FIGS. 2 and 3 for feeding sheets into the inversion nip formed between drive roll 41 and idler roll 42. Movement of the diverter from its home position to an actuated position is triggered by the position of the trail edge of the sheet that is within the diverter.

It should now be understood that an improved diverter arrangement has been disclosed that increases the productivity of a printer by reducing the length and costs of the usually required long paper path for duplexing purposes and, in addition, curtails the distance a sheet usually travels. These enhancements are accomplished with the use of a letterbox diverter configuration that enables the diverter to operate as soon as a trail edge of a sheet passes a post fuser nip. The letterbox gate moves to direct the sheet to an invert path so that reversing drives of an inverter can be actuated while simultaneously positioning a lower integrated baffle to direct subsequent sheets toward a first output tray as required. This reduces the time required for the sheet to be in the inverter path before reversing sheet direction. A further advantage of the letterbox diverter configuration is the reduction of the number of required paper guides.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for directing sheets in multiple directions with a multi-positionable diverter in a printing apparatus, comprising:

providing said multi-positionable diverter with integral upper and lower portions;

providing said multi-positionable diverter with a paper path extending between said upper and lower portions thereof for the passage of sheets therethrough;

providing a rotatable shaft on which said multi-positionable diverter is mounted, said rotatable shaft being adapted to pivot said multi-positionable diverter from a first position to a second position; and configuring said lower portion of said multi-positionable diverter to include an outer surface portion thereof for guiding a sheet in a first direction while a top portion of said lower portion is configured to simultaneously guide a second sheet in an opposite direction.

* * * * *